United States Patent [19]

Pickles

[11] 4,420,906

[45] Dec. 20, 1983

[54] WINDOW REGULATOR

[75] Inventor: Joseph Pickles, Birmingham, Mich.

[73] Assignee: Ferro Manufacturing Corporation, Southfield, Mich.

[21] Appl. No.: 314,668

[22] Filed: Oct. 26, 1981

[51] Int. Cl.[3] ..... E05F 11/48

[52] U.S. Cl. ..... 49/352; 49/349; 49/360; 49/375

[58] Field of Search ..... 49/352, 360, 362, 227, 49/374, 349, 375; 74/89.2

[56] References Cited

U.S. PATENT DOCUMENTS

| | | | |
|---|---|---|---|
| 3,062,528 | 11/1962 | Martens | 49/227 |
| 3,415,016 | 12/1968 | Lystad | 49/227 |
| 3,888,044 | 6/1975 | Lystad | 49/227 |
| 4,051,632 | 10/1977 | Fukumoto et al. | 49/227 X |
| 4,168,595 | 9/1979 | Pickles et al. | 49/352 |
| 4,241,542 | 12/1980 | Podolan et al. | 49/352 |
| 4,253,277 | 3/1981 | Campbell et al. | 49/352 |
| 4,299,057 | 11/1981 | Hangeman et al. | 49/352 X |

*Primary Examiner*—Philip C. Kannan

*Attorney, Agent, or Firm*—Barnes, Kisselle, Raisch, Choate, Whittemore & Hulbert

[57] ABSTRACT

A regulator for the window glass of a motor vehicle comprising a guide bracket, means for moving the guide bracket generally vertically between raised and lowered position and a floating bracket pivotally connected to a guide bracket about a generally horizontal axis extending longitudinally of the vehicle and adjacent the lower edge portion of the glass to provide for changing orientation of the glass about the aforesaid axis as the glass is raised and lowered.

3 Claims, 9 Drawing Figures

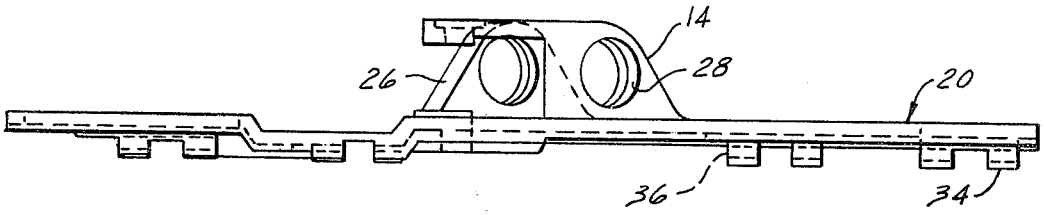
FIG. 7
FIG. 8
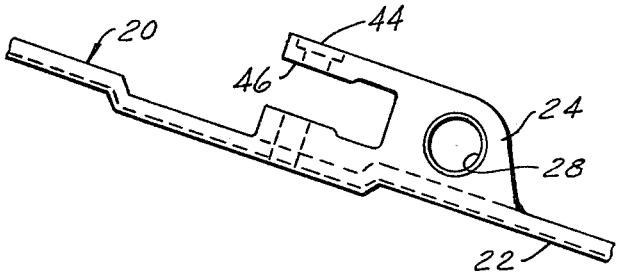
FIG. 9
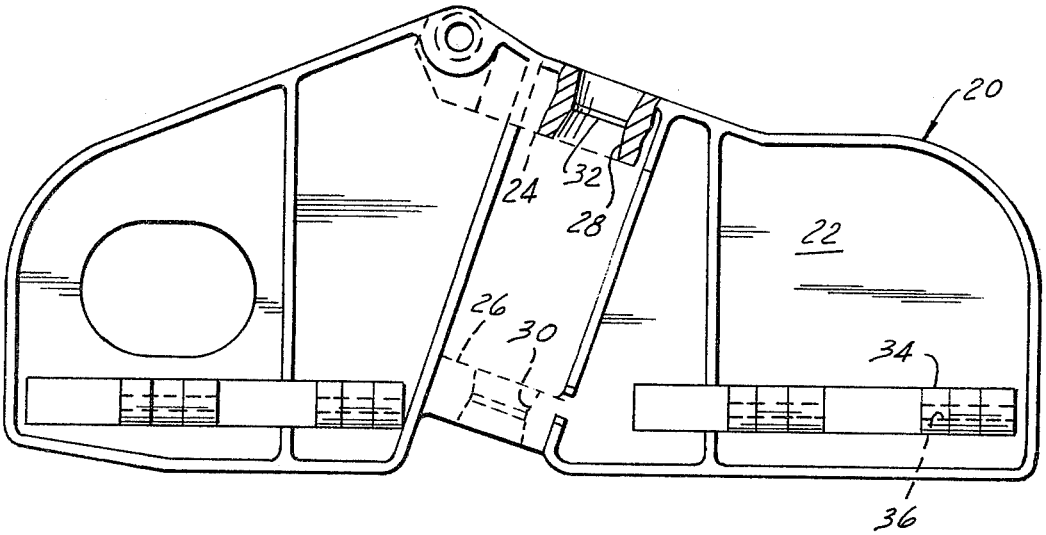

WINDOW REGULATOR

BRIEF SUMMARY OF THE INVENTION

The present invention relates to window lift mechanism of the known type in which an elongated flexible rack or tape is slidable longitudinally on a functionally rigid track support and has one end thereof attached to the lower portion of a vehicle window. The track may be bent to have large radius curves. The flexible rack is in mesh with a driving pinion to raise and lower the window.

The improvement over prior art, such as Pickles et al. U.S. Pat. Nos. 4,168,595 and Pickles 4,229,906, is in the adaption of the mechanism to provide for an angular change of orientation of the window about a generally horizontal axis extending fore and aft of the vehicle adjacent the bottom edge of the window, as it is raised and lowered. More specifically, the general plane occupied by the window is inclined inwardly of the vehicle as it is raised. The window itself is interiorly concave so that in raised position, the upper part of the window overlies a substantial portion of the interior passenger space.

This is accomplished herein by providing a generally upright but somewhat inclined and slightly curved rigid guide post to determine the path traversed by the lower part of the window. This post is fixed within a hollow door or appropriate body construction of the vehicle, and the glass may be substantially fully retracted into the cavity thus provided.

A guide bracket is slidably mounted on the post and is attached to one end of the flexible rack. A pinion is mounted within the cavity in mesh with the rack and is connected to be driven by a reversible electric motor.

A floating bracket is fixed to the lower portion of the window, and is pivotally connected to the guide bracket to accommodate the change in angular orientation of the window as it is raised and lowered.

It will be understood that the vehicle is provided with suitable guide means to determine the changing orientation of the window as its lower portion is moved generally in parallelism to the guide post.

BRIEF DESCRIPTION OF THE DRAWINGS

FIG. 7 is an elevational view of the guide bracket.

FIG. 8 is a projected edge view of the bracket shown in FIG. 7.

FIG. 9 is a plan view of the bracket of FIG. 7.

DETAILED DESCRIPTION

Figure 3:
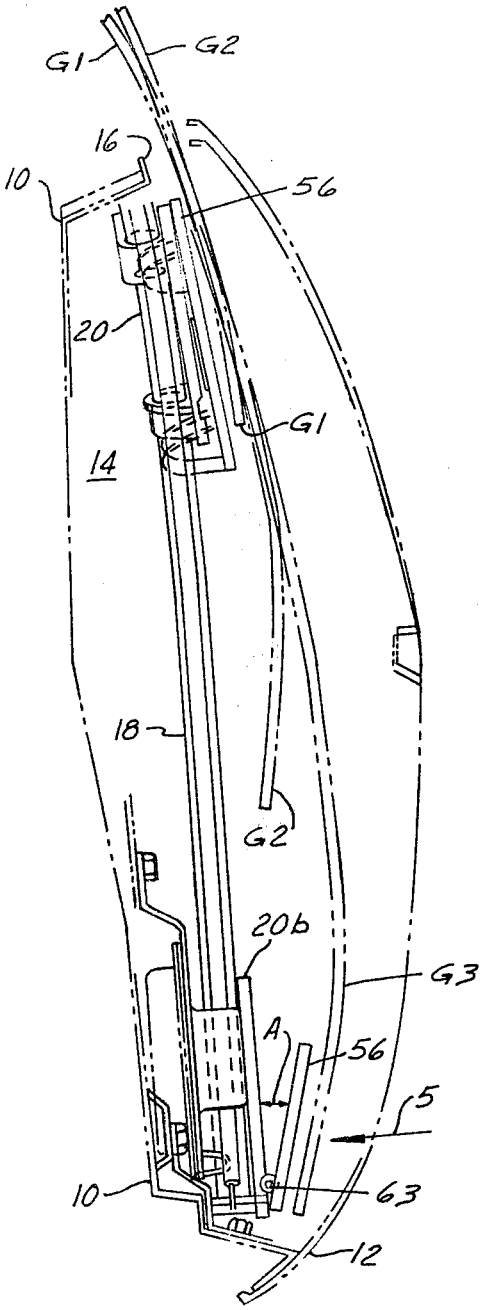
FIG. 3 is an elevational view of the structure of FIG. 1, viewed from the left thereof.

In FIG. 3 there is illustrated portions of an inner door panel 10, and outer door panel 12, spaced apart to define a hollow interior or cavity 14, the upper edges of the panels having ledge portions extending toward each other to form a sill having a slot 16 through which the curved glass indicated generically by the letter G but designated in raised, intermediate, and lowered position as G1, G2 and G3 respectively, is movable.

Figures 1, 2:
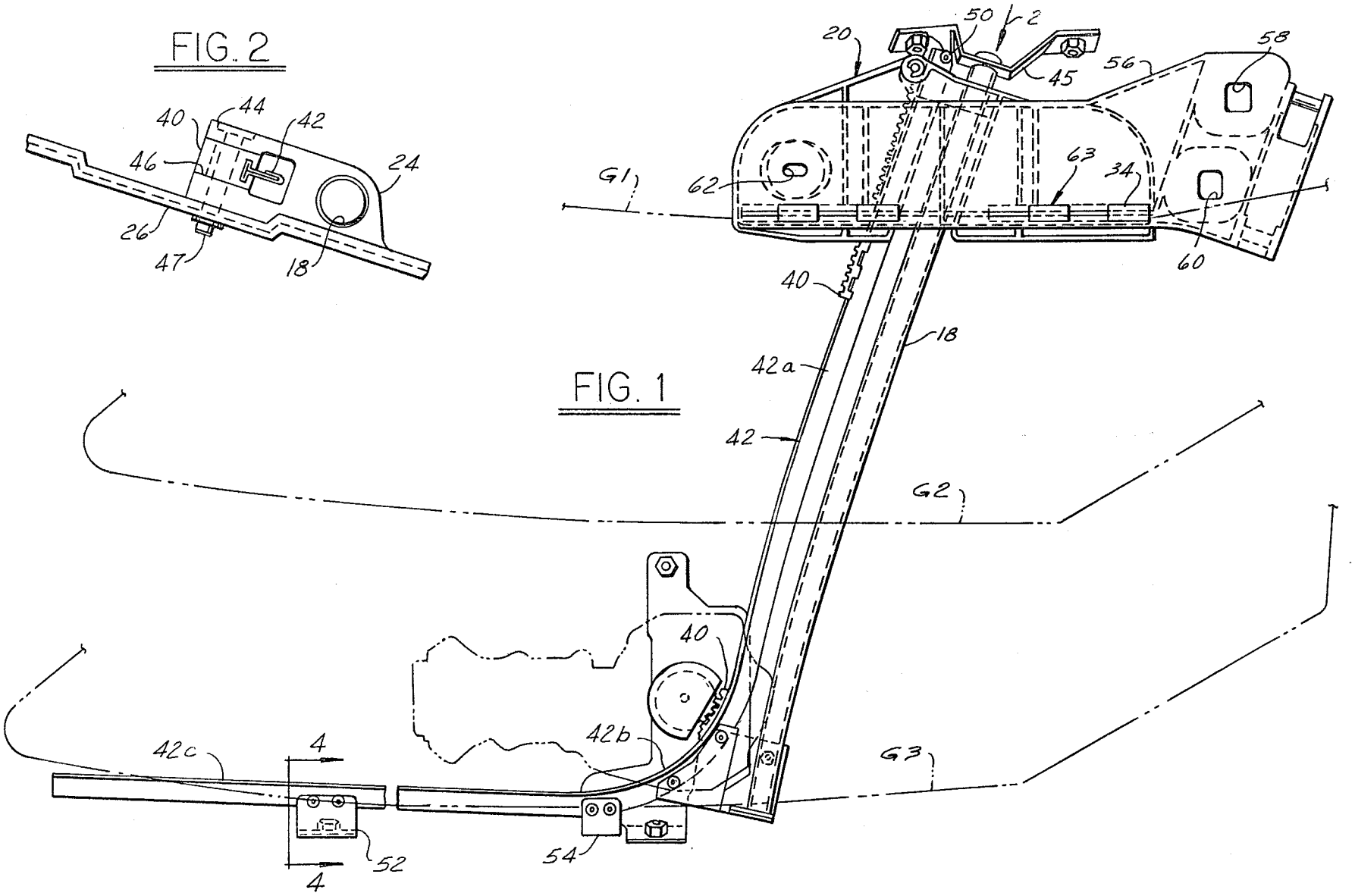
FIG. 1 is an elevational view of the mechanism illustrating its relationship to portions of the vehicle in various window positions.
FIG. 2 is a fragmentary generally plan view showing the coaction of the guide post, guide bracket, track, and flexible rack.

Within the door cavity 14 there is fixed a generally upright guide post 18, which is in the form of a tube. As seen in FIG. 1, the post is inclined slightly forwardly and upwardly, and as illustrated is slightly curved forwardly and upwardly. Similarly, as seen in FIG. 3, the post is inclined slightly inwardly and upwardly, and in addition is slightly curved inwardly and upwardly.

Movable longitudinally on the post designated generally at 18 is a guide bracket 20, shown in FIG. 3 at the top of post 18, but which is movable downwardly to the bottom position shown at **20*b*** in this Figure.

Details of this bracket are best seen in FIGS. 7–9, to which attention is now directed.

Bracket 20 is formed of a suitable rigid, low friction plastic material such as an acetal resin sold by DuPont under their name Delrin 100. It is essentially in the form of a flat plate 22 having upper and lower ears 24, 26 having openings 28, 30 therein which as best seen in fragmentary section in FIG. 9, are inwardly tapered from both ends to define a central narrow contact band 32. The openings receive the guide post 18 and since they are spaced apart a substantial distance, they insure stability of the guide bracket on the post.

The guide bracket is ribbed as shown for reinforcement, and at its lower edge portion is provided with widely spaced pairs of hinge projections or lugs 34 having aligned apertures 36 to receive a pivot pin as will subsequently be described.

Figure 4:
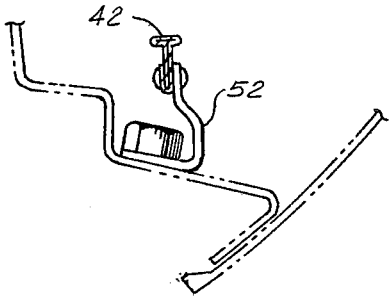
FIG. 4 is a fragmentary section on the line 4—4, FIG. 1.
Figure 5:
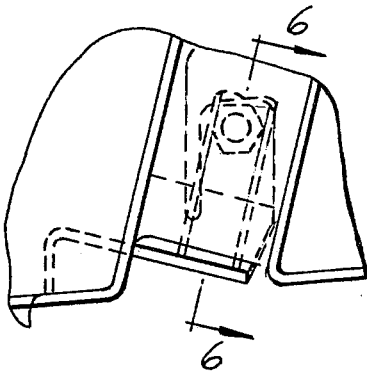
FIG. 5 is a fragmentary view in the direction of the arrow 5 in FIG. 3.
Figure 6:
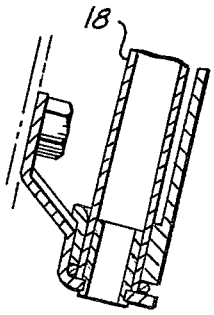
FIG. 6 is a section on the line 6—6, FIG. 5.

In addition, guide bracket 20 is provided with means for securing it to a flexible rack 40 slidable longitudinally on an operationally rigid track 42 for raising and lowering the window. The track is of T-shaped cross-section as best seen in FIG. 4, and conveniently may be fabricated from strip to the illustrated configuration. The cross element of the T is received within a recess formed at the rear of the flexible rack 40 by rearwardly and then inwardly extending flanges. The T-shaped track and flexible rack are fully disclosed in my prior Pat. No. 4,168,595, to which reference is made for details. It is to be noted that the track may be bent to a required configuration, to include its very slightly curved upright portion **42*a* as well as the curved portion indicated at 42*b* which connects the upright portion with the horizontal portion 42*c***.

The connection between the upper end of the flexible rack 40 and the guide bracket 20 are best seen in FIGS. 1 and 2. The upper ear 24 of the guide bracket has a lateral extension 44 slotted as indicated at 46. The inner end of the slot is enlarged to receive the T-track 42. The upper end of the flexible rack 40 is received in slot 46 and fixed therein by pin 47.

The upper end of the T-track 42 is secured to a fixed bracket 48 by rivet 50, and lower portions thereof are fixed by brackets 52, 54.

The window glass G has a substantial lateral curvature, as best seen in FIG. 3, which is inwardly concave, and in its upper position it is guided to overlie the interior of the vehicle. In its lower position to accommodate this change in orientation of the glass, which amounts to a pivoting of its upper portion about a substantially horizontal pivot axis adjacent its lower edge as it is raised and lowered, the lower edge portion of the glass is fixed to a floating bracket 56 by fasteners and spacers (not shown) cooperating with openings 58, 60 adjacent one end of the floating bracket, an elongated opening 62 adjacent the other end thereof, and registering openings adjacent the lower edge of the glass.

As can be seen in FIG. 3, when the glass is in its lowered position with its lower edge in the position indicated at G3, the floating bracket 56 is required to extend at a substantial angle A with respect to the guide bracket 20. This is permitted by hingeing the lower edge portion of floating bracket 56 to the lower edge portion of guide bracket 20. This hingeing is provided by pivot pins 63 extending through the apertured lugs 34 on the edge portion of the guide bracket 20 and similar offset lugs on the floating bracket.

It will be apparent that as the guide bracket 20 is pushed by along post 18 by the flexible rack 40, the plane of its plate portion 22 will be maintained essentially parallel to the guide post. However, the plane occupied by the lower edge portion of the window glass changes its orientation with respect to the plane of the guide bracket, and this is provided for by hinge mounting indicated in its entirety at 63 in FIG. 3. The position of the lower edge portion of the glass is indicated in mid-position at G2 and in full elevated position at G1. It will be noted that in position G1, the lower edge portion of glass, guide bracket 20, and floating bracket 56 are all substantially parallel, and the upper portion of the glass is curved inwardly and upwardly. The instantaneous orientation of the window as it is raised and lowered is of course determined by guide structure provided in the window opening.

I claim:

1. Window regulating mechanism for a vehicle window glass which is moved generally vertically between open and closed position and is tilted during vertical movement about a substantially horizontal axis located adjacent the lower edge of the window and extending longitudinally of the vehicle in accordance with its vertical position, which comprises a generally upright guide post, a guide bracket slidable on said post, a floating bracket adapted to be fixed to the lower edge portion of the window and pivotally connected to said guide bracket by hinge means acting between said guide bracket and said floating bracket and having a pivot axis extending substantially horizontally and longitudinally of the vehicle and located adjacent the lower edge of the window, means for moving said guide bracket longitudinally of said post comprising a functionally rigid guide track, an elongated flexible drive member slidably supported on said track, rotary drive means engaging said flexible drive member, said guide bracket being of horizontally elongated plate like configuration occupying a generally vertical plane, said guide bracket having laterally extending ears adjacent its upper and lower edges, said ears having openings therethrough slidably interfitting with said post, one of said ears having a second opening in the form of an open ended slot, said slot having an inner portion receiving and being movable along said track, the outer end of said slot receiving and being closed by an end portion of said flexible drive member, and means fixing the end portion of said flexible drive member to said guide bracket.

2. Mechanism as defined in claim 1, in which said slot is formed in a lateral extension of the ear in which it is provides, said slot being enlarged at its inner end to receive and accomodate said track.

3. Mechanism as defined in claim 1, said guide bracket and said floating bracket are formed of a rigid, low friction plastic material, in which the openings in the guide bracket are in direct sliding engagement with said post, and in which the hinge means connecting the brackets comprise widely spaced apertured lugs integral with said brackets and aligned to receive a hinge pin.

* * * * *